United States Patent [19]

Wünsch

[11] Patent Number: 4,457,160

[45] Date of Patent: Jul. 3, 1984

[54] AUTOMATIC PUNCHING AND BENDING MACHINE

[76] Inventor: Adolf Wünsch, Haus Nr. 210, D-8959 Seeg-Ried, Fed. Rep. of Germany

[21] Appl. No.: 343,079

[22] Filed: Jan. 27, 1982

Related U.S. Application Data

[63] Continuation of Ser. No. 108,528, Dec. 31, 1979.

[30] Foreign Application Priority Data

Jun. 27, 1979 [DE] Fed. Rep. of Germany ..... 2925840

[51] Int. Cl.[3] ..... B21J 13/00

[52] U.S. Cl. ..... 72/446; 72/335; 72/464; 29/33 S; 29/33 Q; 83/205

[58] Field of Search ..... 72/404, 405, 455, 447, 72/446, 333, 335, 464, 473; 29/34 R, 33 S, 33 Q, 41, 52; 74/16; 83/255, 405

[56] References Cited

U.S. PATENT DOCUMENTS 2,567,128 9/1951 Shoffner ..... 74/16
2,925,847 2/1960 Burns et al. ..... 72/405

FOREIGN PATENT DOCUMENTS 482605 4/1952 Canada ..... 29/33 Q

*Primary Examiner*—Daniel C. Crane
*Assistant Examiner*—David B. Jones
*Attorney, Agent, or Firm*—Kuhn, Muller and Bazerman

[57] ABSTRACT

In an automatic punching and bending machine the interspace between the bending device and the punching device is adjustable in order to make the interspace as small as possible and to adjust that interspace in dependence on the length of the working piece of a band material, thereby gaining the advantages that series of different work pieces of high precision can be produced in the same machine. The bending device is removable and can easily be replaced by another one which has been reset in a preceding working process. Therefore standstill periods of the machine are reduced.

4 Claims, 12 Drawing Figures

AUTOMATIC PUNCHING AND BENDING MACHINE

This is a continuation, of application Ser. No. 108,528, filed Dec. 31, 1979.

BACKGROUND OF THE INVENTION

The present invention relates to an automatic punching and bending machine for the production of multiform small parts from metal band or wire comprising a draw-in system for the band or wire, a punching device and at least one bending device, the bending device consisting of a plurality of slide units each provided with a bending tool, the slide units being arranged around a central working station, and a central driving mechanism for driving the plurality of bending tools, the punching device and the draw-in system.

In known punching and bending machines of this kind, the punching device and the bending device form a construction unit with a fixed space between one another. This space is large with respect to the longitudinal dimensions of the small parts to be produced. Difficulties arise with respect to the exact transport of the small work pieces between the punching device and the bending device if different series of small work pieces are to be produced in the machine.

SUMMARY OF THE INVENTION

One object of the invention is to provide a punching and bending machine which can be easily reset or adapted for the production of different work pieces.

It is further one object of the present invention to provide an improvement of the known machine in order to avoid an inaccurate delivery of the work pieces from the punching device to the bending device especially when work pieces of different dimensions are to be produced by the machine.

Further objects and advantages of the invention will be gained from the following description.

The automatic punching and bending machine mentioned above is improved in that the punching device and the bending device are displaceably arranged relatively to one another in the feeding direction of the band or wire material and are adjustable with respect to the longitudinal dimension of the small parts.

The present invention has the advantage that the punching device and the bending device can be arranged with a small spacing such that only one or a few work pieces have a space between them. In contrast to the known machine, the sum of the unavoidable inaccuracies in the length of the work pieces is remarkably less and it is ensured that each working piece comes into an accurate position within the bending device. The machine according to the invention can easily be adapted for the production of working parts of different dimensions. The spacing between the punching device and the bending device can accurately be adjusted with respect to the longitudinal dimension of the work pieces. Therefore, the degree of accuracy of the produced work pieces is greater and the machine can be used with a higher versatility, because very small work pieces can be produced as well as bigger ones.

A further important feature of the invention lies in that the bending device as a whole is removably and exchangeably arranged with respect to the punching device. Thereby the advantage is gained that the machine can be operated to produce bent metal articles while at this time another bending device can be prepared for the production of different articles. Then the bending devices need only be exchanged and after the new device having been adjusted with respect to the length of the articles to be produced the machine can be started again. The standstill periods are reduced and the utilization factor of the machine is increased.

A further feature of the invention lies in that a moving track of the bending device or punching device is offset in a direction parallel to the axis of a central wheel of the bending device by an amount that the bending device and/or the punching device can be moved, into relative positions overlapping one another, in the feeding direction of the band or wire material. By this overlapping, the smallest possible spacing between the center of the bending device and the center of the punching device is gained. According to a first alternative, the bending device can be moved longitudinally behind the punching device and, in the case of a horizontally arranged main wheel or central wheel of the bending device, a second alternative consists in that the bending device is movable into a position at least partly beneath the punching device. For this purpose, the punching device can be arranged on a blind case which is removable to provide place for the bending device.

BRIEF DESCRIPTION OF THE INVENTION

DESCRIPTION OF THE PREFERRED EMBODIMENTS

Figure 1A:
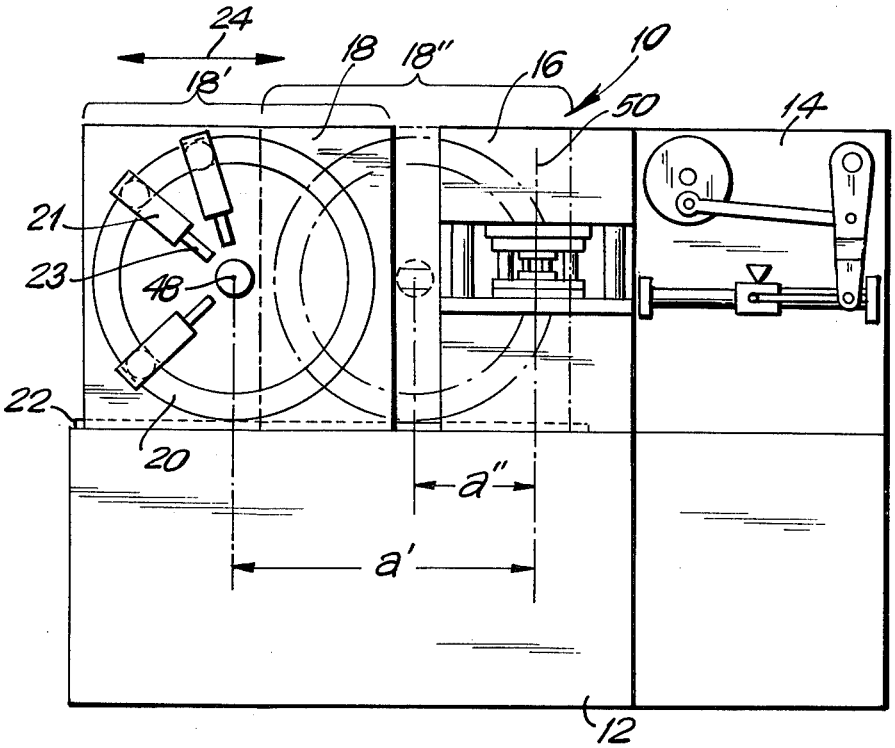
FIG. 1A shows a schematic side view of a punching and bending machine.
Figure 1B:
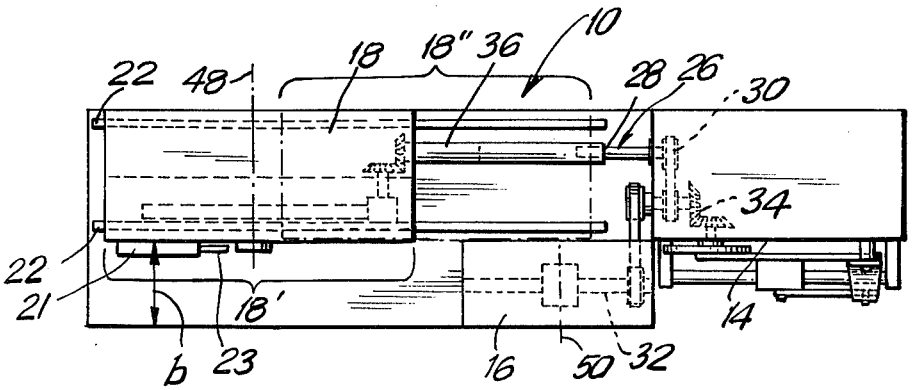
FIG. 1B shows a plan view of the machine according to FIG. 1A.

FIG. 1 shows schematically an automatic punching and bending machine 10 which comprises a machine base 12 on which are mounted a draw-in system 14, a punching device 16, and a bending device 18. The bending device 18 has a central wheel 20 on which are mounted a plurality of radially arranged slide units 21 as known each supporting a bending tool 23. On the machine base 12 there is fastened a slide guide rail arrangement 22, extending in the longitudinal direction of the base 12 and in the rearward half thereof, whereas the punching device 16 is arranged in the front half. By means of the guide rail arrangement 22 the bending device 18 is displaceably guided in the directions of the double arrow 24, from a position 18′ shown in full lines into a position 18″ shown in dotted lines. In the first position 18′ the bending device 18 as a whole is spaced from the punching device 16 whereas, in the second position 18″ the bending device 18 has been moved in the direction of the punching device by more than half of its length, thereby having reduced the interspace a′ between the axis 48 of the bending device 18 and the center 50 of the punching device, 16, 20. Because the valve a of the transverse offset b between the guide rail arrangement 22 for the bending device 18 and the punching device 16 shown in FIG. 1B the bending device 18 in the position 18″ and the punching device 16 are in overlapping condition and the bending device in the position 18″ lies partly behind the punching device 16.

Figure 5A:
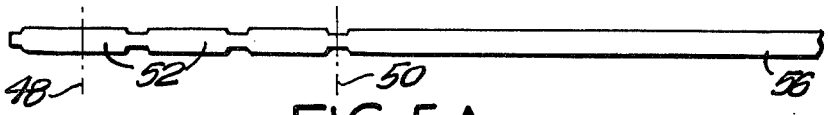
FIG. 5A shows a band of relatively large work pieces.
Figure 6A:
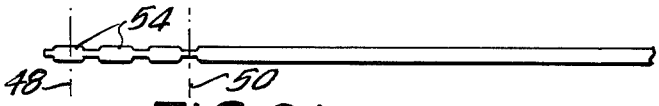
FIG. 6A shows a band of relatively small workpieces.

The interspace a between the bending device 18 and punching device 16 is chosen as small as possible dependent on the length of the work pieces 52, 54 (FIG. 5A and 6A) to be produced that means dependent on the pitch of the band or wire material 56.

The automatic punching and bending machine 10 has a central driving mechanism 26, the main shaft 28 of which drives an eccentric shaft 32 of the punching device 16 or press by means of a chain or belt 30 and also drives the draw-in system 14 via bevel gears 34. The draw-in system 14 and the punching device 16 are combined as a structural unit, from which the bending device 18 is separated which is drivingly connected with the main shaft 28 by means of a toothed hollow shaft 36 into which the main shaft 28 is telescopically inserted. Therefore the bending device 18 is in driving connection with the main shaft 28 in any of its displaced positions 18′, 18 on the machine base 12.

Figure 2A:
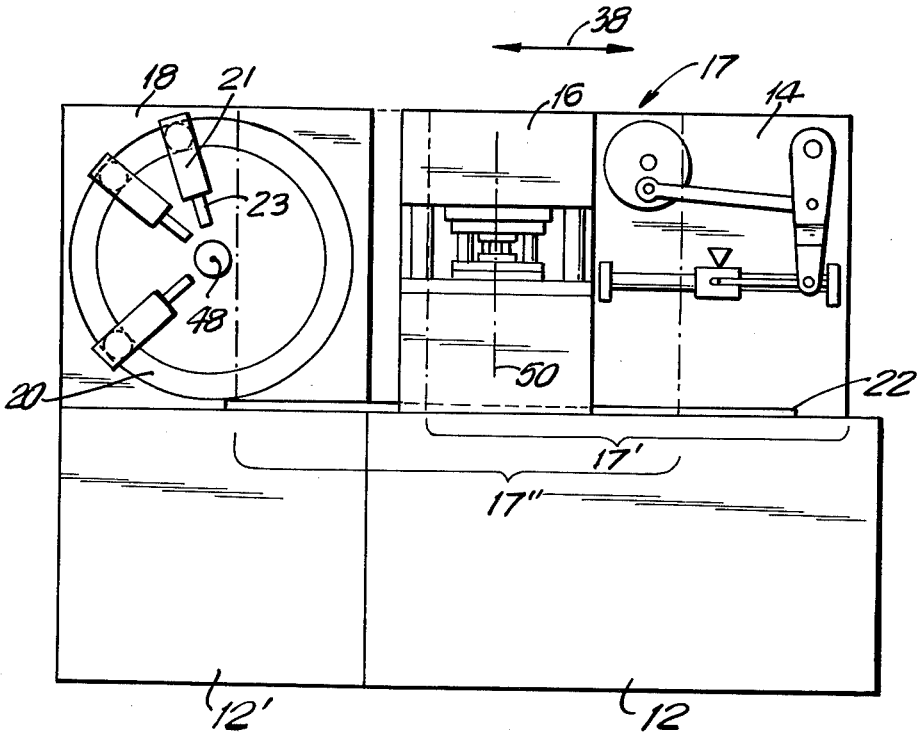
FIG. 2A shows a schematic side view similar to FIG. 1A, but with the bending device being displacably arranged on an own base.
Figure 2B:
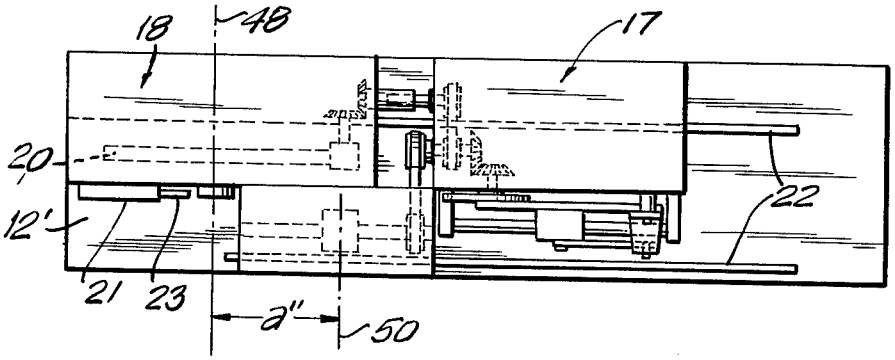
FIG. 2B shows a plan view of the machine according to FIG. 2A.

FIGS. 2A, 2B differ from FIGS. 1A, 1B in that the bending device 18 is fixed on an own base 12′ and this unit is removable from the machine base 12 as a whole in order to reset the bending device 18 at another place while a prepared new bending device 18 can easily be connected with the machine base 12. While the bending device 18 is fixed on its base 12′, the unit 17 consisting of the draw-in system 14 and the punching device or press 16 is movably supported a slide guide rail arrangement 22 the base 12 in the direction of the double arrow 38, i.e. parallely with the feeding direction of the band or wire between a first position 17′ shown in full lines and a second position 17″ shown schematically in dotted lines in the side view of FIG. 2A. In the plan view of FIG. 2B the second position 17″ of the unit 17 is shown in full lines in which the axis 48 of the bending device 18 the center 50 of the punching device 16 have a minimum interspace a″ and therefore said devices 16, 18 are in maximum lap condition.

Figure 3A:
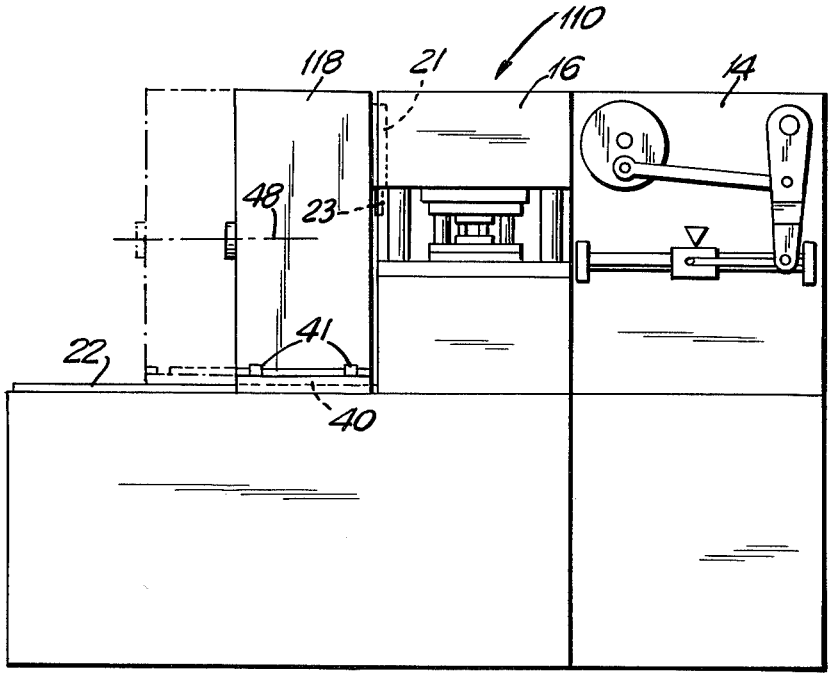
FIG. 3A shows a schematic side view of a punching and bending machine, in which the bending device is mounted in transverse direction, the axis of the central wheel of the bending device is parallel with the feeding direction of the band or wire material.
Figure 3B:
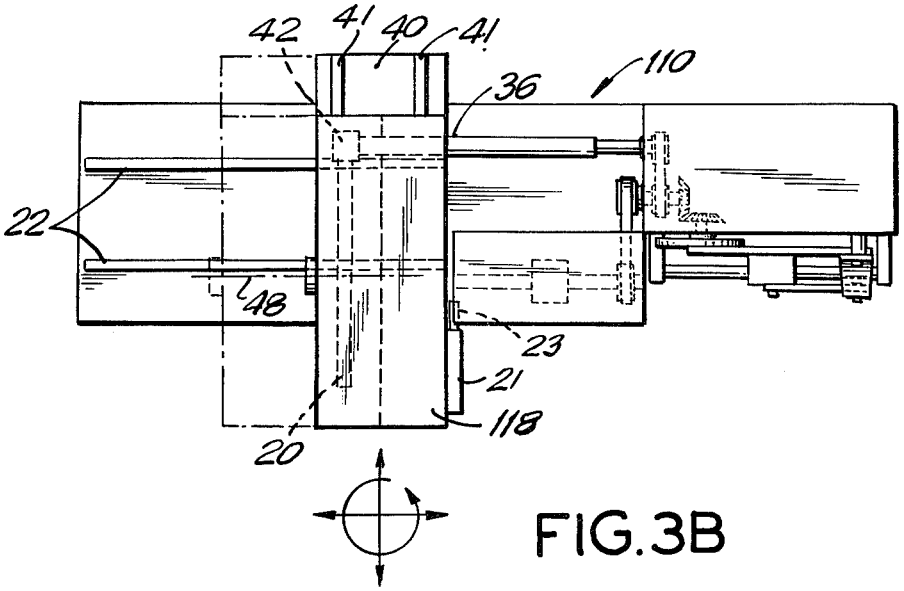
FIG. 3B shows a plan view of the machine according to FIG. 3A.

FIGS. 3A, 3B shows a punching and bending machine 110 in which the punching device 16 and the draw-in system 14 are not modified but a bending device 118 is movably mounted on guide rails 41 in a transverse direction on a slide 40 which is movable in longitudinal direction on the guide rails 22. The bending device 118 is mounted in a position as turned by 90° with respect to FIG. 1A such that the axis 48 of the central wheel 20 lies parallely with the feeding direction of the bend or wire. The telescopical toothed shaft 36 is connected with a pinion 42 which engages the toothed outer circumference of the central wheel 20.

Figure 4A:
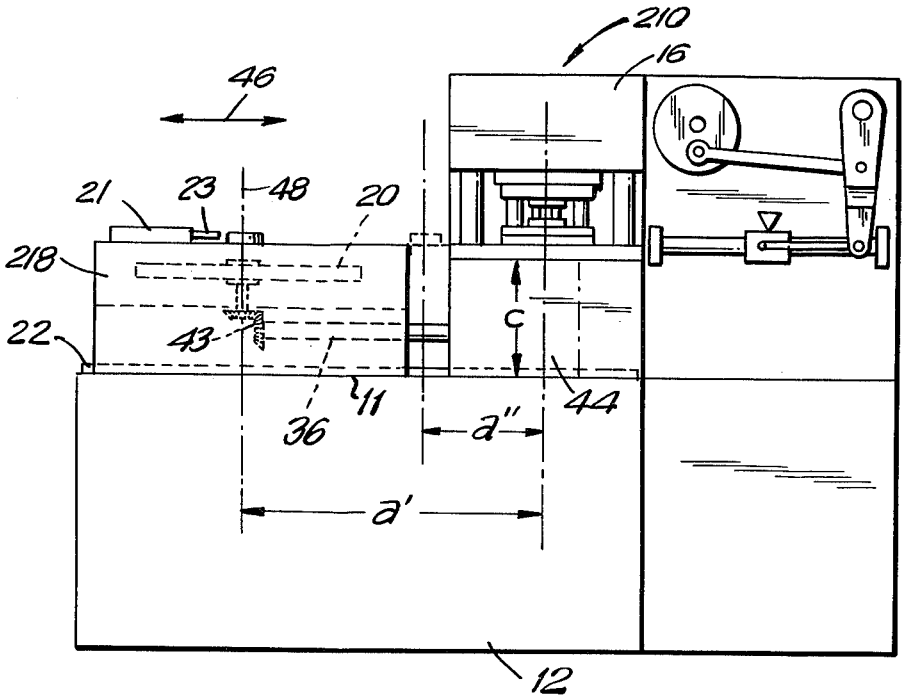
FIG. 4A shows a schematic side view of punching and bending machine in which the axis of the central wheel lies vertically.
Figure 4B:
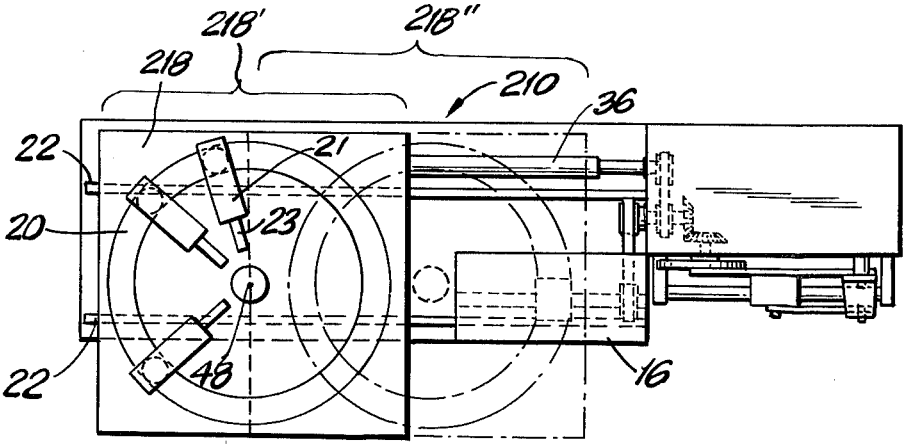
FIG. 4B is a plan view of the machine according to FIG. 4A.

FIGS. 4A, 4B shows a punching and bending machine 210 having a horizontal bending device 218. The axis 48 of the central wheel 20 extends vertically. The punching device 16 is arranged above the upper surface 11 of the base 12 with a vertical interspace c equal with the height of the bending device 218. This interspace c can be filled by a blind case 44 the height of which corresponds to that of the bending device. After removal of the blind case 44 the bending device 218 can be moved on guide rails 22 from a position 218′ into the space below the punching device and 16 in the direction of the double arrows 46 (position 218″). The largest interspace a′ between the centers 48, 50 of the bending device 218 and the punching device 16 is shown in full lines in FIG. 4A, 4B while the smallest interspace is shown by dotted lines in which position almost half of the bending device 218 lies below the punching device 16. The bending device 218 is driven via a telescopical shaft connection 36 and a bevel gear arrangement 43.

Figure 5B:
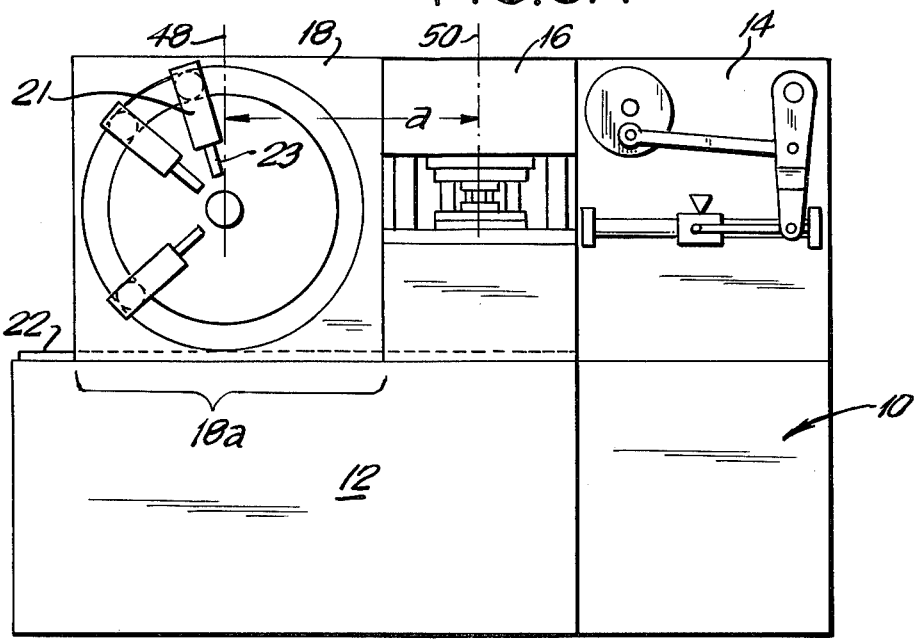
FIG. 5B shows a schmatic side view of a punching and bending machine in which the interspace between the bending device and the punching device is adjusted for the production of the relatively large workpieces according to FIG. 5A.
Figure 6B:
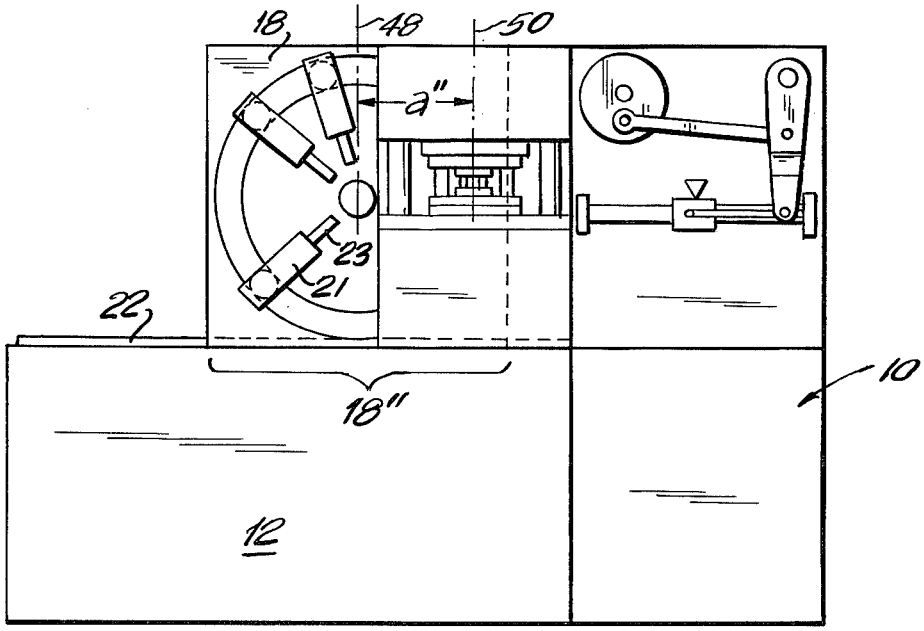
FIG. 6B shows the machine of FIG. 5B adjusted to a reduced interspace between the punching device and the bending device and adapted to produce the smaller workpieces according to FIG. 6A.

FIG. 5B shows the punching and bending machine 10 according to FIGS. 1A, 1B with the bending device 18 being in a somewhat displaced position 18*a* with respect to the position 18′ but without overlapping the punching device 16. The interspace 16 between the axes 48 and 50 marked with dot and dashes is exactly adjusted to the pitch of the band 56 of work pieces 52 (FIG. 5A) and amounts accurately two and a half times the length of a work piece 52. If the machine is to be adapted to work pieces 54 (FIG. 5A) of shorter dimensions the bending device 18 must be moved to the right as shown in FIG. 6B into a position 16″ in which the interspace a″ between the axes 48 and 50 is reduced and corresponds exactly with the pitch of the band of the smaller work pieces 54. Also in this example this interspace a is two and a half times as large as the length of the work piece 54. Generally speaking the interspace must be two times, three times, four times and so on as great as the work piece longitudinal dimension plus a half working piece length respectively. The additional half length is required because the punching device center 50 coincides with the middle between two adjacent work pieces whereas the center 48 of the bending device coincides with the middle of the work piece itself.

A main advantage of this invention gained by the displaceable arrangement of the bending device and the punching device relatively to one another lies in that very small work pieces and remarkably longer work pieces can be produced in the same machine. Further it is advantageous that the machine always operates with a high precision because between the punching device and the bending device only a small number of work pieces are situated, so that the sum of tolerances is extremely low and the work pieces can be accurately delivered to the centre of the bending device. Last but not least it is highly advantageous that the bending device can be fully removed from the rest of the machine in order to replace it by another one which has been reset and adapted to different bending operations in a preceding working process at another working place. The standstill periods of the machine therefore are substantially reduced.

Some modifications can be made without leaving the scope of this invention. Instead of having only one bending device 18, 118 or 218 a plurality of bending devices can be arranged in series. The machine not only has a draw-in system, a punching device or press, and a bending device but additionally other working devices can be inserted into the working process as milling machines, plastic moulding machines and so on. The machine further is not limited to operating with a band material but also a row of separate work pieces abutting one another can be handled.

What I claim is:

1. An improvement in an automatic punching and bending machine for punching and bending stock material, in form of a band of work pieces fed by a draw-in device, the draw-in device, a punching device and a bending-device being mounted in series in the feeding direction of the band of work pieces on a machine base, the improvement comprising: a slide guide rail arrangement mounted on the machine base and extending parallel with the feeding direction of the band of work pieces, the bending device being displaceably guided in said slide guide rail arrangement between a first end position and a second end position laterally offset to the feeding direction with respect to the punching device whereby, in one end position of the bending device, said bending device and the punching device are in an overlapping condition as seen perpendicular to the feeding direction of the band of work pieces.

2. An improvement in an automatic punching and bending machine for punching and bending stock material, in form of a band of work pieces fed by a draw-in device, the draw-in device, a punching device and a bending-device being mounted in series in the feeding direction of the band of work pieces on a machine base, the improvement comprising: a slide guide rail arrangement mounted on the machine base and extending parallel with the feeding direction of the band of work pieces, the bending device being displaceably guided in said slide guide rail arrangement between a first end position and a second end position laterally offset to the feeding direction with respect to the punching device whereby, in one end position of the bending device, said bending device and the punching device are in an overlapping condition as seen perpendicular to the feeding direction of the band of work pieces, and wherein the bending device comprises: a central driving wheel drivingly connected with one part of a two-part toothed telescoping shaft, extending in parallel direction with the slide guide rail arrangement and the second part of the telescoping shaft forming a main driving shaft of the machine and being drivingly connected with a driving shaft of the punching device.

3. An improvement as claimed in claim 1, wherein in said one end position of the bending device, said bending device is positioned partly behind the punching device.

4. An improvement as claimed in claim 1, wherein in said one end position of the bending device, said bending device is positioned partly below the punching device.

* * * * *